United States Patent [19]

Nagakura

[11] Patent Number: 4,498,328

[45] Date of Patent: Feb. 12, 1985

[54] PRESS DEVICE

[75] Inventor: Seiju Nagakura, Ama, Japan

[73] Assignee: Toyokoki Co., Ltd., Jushiyama, Japan

[21] Appl. No.: 487,370

[22] Filed: Apr. 21, 1983

[30] Foreign Application Priority Data

Apr. 30, 1982 [JP] Japan ..... 57-73577

[51] Int. Cl.[3] ..... B21D 37/00

[52] U.S. Cl. ..... 72/482; 72/389; 72/452; 72/446; 72/478

[58] Field of Search ..... 72/389, 386, 465, 452, 72/448, 446, 482, 481, 473, 478

[56] References Cited

U.S. PATENT DOCUMENTS 4,434,645 3/1984 Sverel et al. ..... 72/402

FOREIGN PATENT DOCUMENTS 2007259 2/1970 Fed. Rep. of Germany ..... 72/446
2355867 5/1975 Fed. Rep. of Germany ..... 72/481
42354 4/1979 Japan ..... 72/481

*Primary Examiner*—Daniel C. Crane
*Assistant Examiner*—David B. Jones
*Attorney, Agent, or Firm*—Jordan and Hamburg

[57] ABSTRACT

A press includes a table for receiving a lower mold and a movable ram which moves up-and-down relative to the table, the ram being provided with a holder for supporting the upper mold utilizing an adapter mounted in alignment on the lower edge of the ram, the adapter being provided with an eccentric shaft member which is operable to adjust the vertical position of the holder relative to the ram by rotating the eccentric shaft member.

7 Claims, 4 Drawing Figures

PRESS DEVICE

BACKGROUND OF THE INVENTION

This invention relates to a press for pressing metal sheets, particularily to a new support structure which holds the upper mold for a press brake or the like.

Conventionally, a press brake forms a designed product by holding the material to be formed between the upper mold fixed to a movable ram through its holder and a lower mold fastened on the table for pressing the material by up and down motion of the movable ram.

In the case of a press brake of larger size, however, where the table is long and the shoulders at both ends of the movable ram are at the end parts of the table, the clearance between the upper and the lower molds at the center part of the ram becomes wider than that at both end parts inasmuch as the hydraulic cylinders press the shoulders at both ends of the ram is such that the center part of the upper mold retracts in pressing the material, resulting in the degradation in accuracy of the product.

Various attempts have been made to prevent this retraction of the upper mold at the center part of the ram, such as providing several hydraulic cylinders near the center part of the movable ram or using liners to adjust the clearance between the two molds. Neither of such remedies successfully adjust the clearance between the molds precisely. Besides, taking too much time for the accompanying adjustment is another disadvantage.

Accordingly, an object of this invention is to provide a press consisting of arranging several adapters on the lower side edge of a movable ram to adjust the relative position of the ram to the holder by turning an eccentric shaft member incorporated in the adapted, thereby keeping the clearance between the upper and lower molds constant over the entire length of the ram during the operation to greatly improve the precision of the formed product.

Hereinafter the invention will be described with references to the accompanying drawings which show a preferred embodiment.

DESCRIPTION OF THE PREFERRED EMBODIMENTS

Figure 1:
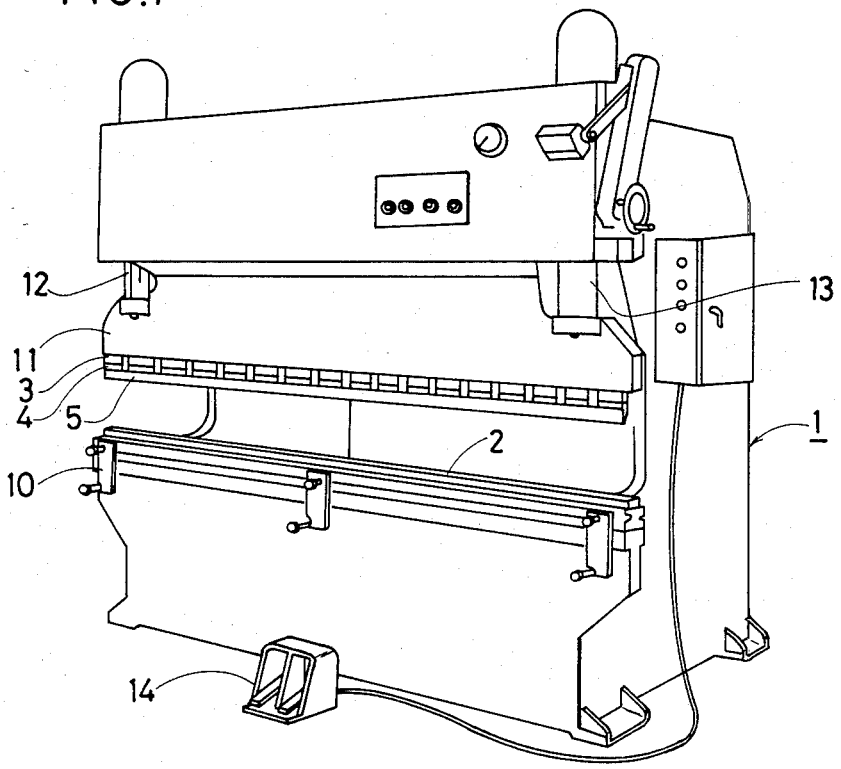
FIG. 1 is a perspective view of a press brake according to one embodiment of the present invention.

FIG. 1 shows a press according to the present invention having a longitudinal table (10) for receiving a lower mold (2), the table (10) being on the front side of a body (1) which faces a movable ram (11) which is reciprocable up and down against the table (10). On shoulder parts at both ends of the movable ram (11), hydraulic cylinders (12) (13) are provided which are operated by a foot pedal (14) for up-and-down motion of the movable ram (11).

On the lower edge of the movable ram, a plurality of adapters (3) are arranged in alignment, and an upper mold (5) is fixed through a holder (4) which is mounted with each adapter (3).

Figure 2:
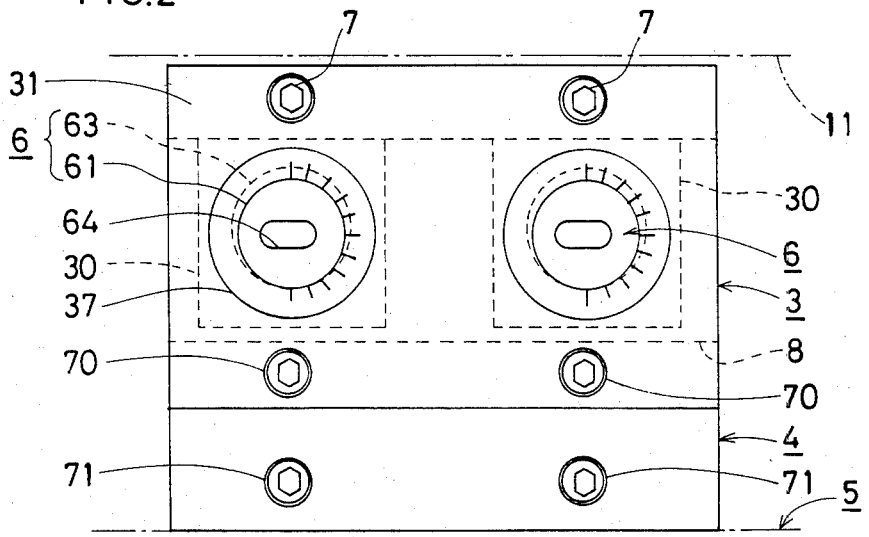
FIG. 2 is a front view showing how the adapter connects with the holder.
Figure 3:
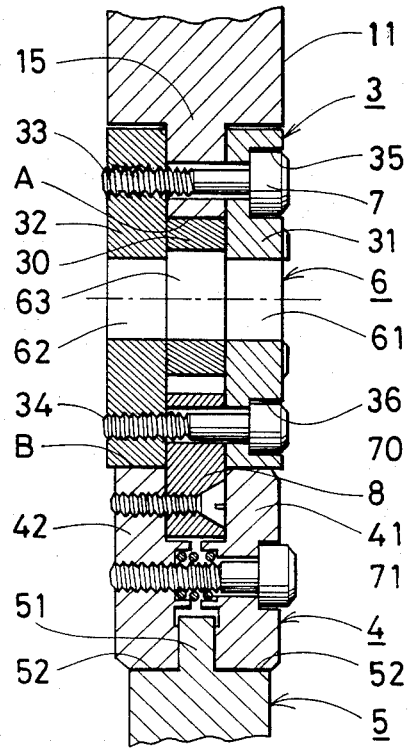
FIG. 3 is a cross sectional view of FIG. 2.

FIGS. 2 and 3 show the support structure of the upper mold (5) including adapters (3) and holders (4).

The adapter (3) comprises a pair of eccentric shaft members (6) (6) on the right and left, on which a front plate (31) and a rear plate (32) are coupled, holding middle plates (30) (30) there between. The rear plate (32) is provided with screw holes (33) (34) for engagement with with bolts (7) (70), and the front plates (31) is provided with support holes (35) (36) for supporting the bolt head respectively in upper and lower positions. The eccentric shaft member (6) is formed so that its center shaft part (63) is eccentric relative to the shaft ends parts (61) (62) and, by turning it with a tool inserted into a guide (64), the center shaft part (63) can be eccentrically rotated. The angle of rotation of the eccentric part (6) can be checked with a guage plate (37) on the front side of the front plate (31).

The adapter (3) is fastened with a projected part (15) of the movable ram (11) with the bolt (7) in the state in which the middle plate (30) is correspondingly positioned on the central part (63) of the eccentric shaft number (6), and the front plate (31) and the rear plates (32) are positioned on the shaft end parts (61) (62) respectively, and in which the projected part (15) of the movable ram (11) is set to abut the upper end of the middle plate (30), and the front plate (31) and rear plate (32) are coupled on both sides of the rear part (15).

The adapter (3) is fastened to a connector plate (8) with the bolt (70) in the state in which the holder (4) is fixed through the connector plate (8) at the lower end part of the adapter (3) and in which the upper end part of the connector plate (8) is inserted between the front plate (31) and rear plate (32).

The holder (4) is provided with a pair of holding pieces (41) (42), between which the support (51) of the upper mold (5) is inserted so that the lower end parts of the holding pieces (41) (42) abut with the top surfaces (52) (52) of the upper mold (5), in which state the upper mold (5) is fastened with the holder (4) with a bolt (71).

Figure 4:
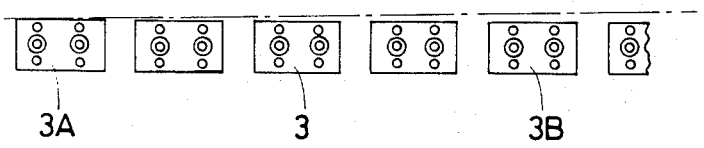
FIG. 4 is an informative view showing the adjusting condition of the adapters.

After the upper mold (5) is fixed, and with the fastening bolts (7) (70) loosened, as the eccentric shaft member (6) is rotated, the center part of the shaft (63) rotates around the turning axis (X) eccentrically, which moves the middle plate (30) up-and-down and left-and-right, changing the position of the middle plates (30) relative to the front plate (31) and the rear plate (32). Consequently, with the movable ram (11) and the middle plate (30) taken as the basis, the abutting surface (B) of the front plate (31) and the rear plate (32) with the holder (4) changes up-and-down in accordance with the turning angle of the eccentric shaft member (6), changing also the up-and-down position of the holder (4) relative to the movable ram (11). Thus, as shown in FIG. 4, adjustment is effected by turning the eccentric shaft member (6) (6) of all adapters (3), so that those adapters (3A) located near the end parts of the ram (11) are set to at a position higher than those adapters (3B) in the center part in relation to the ram (11). Only then is the press put into an operational state for applying pressure, with the bolts (7) of the adapters (3) fastened tightly.

Under said condition of setting, with the material to be formed being placed on the lower mold (2), when the movable ram (11) descends by the operation of of the hydraulic cylinders (12) (13), the material to be formed is pressed between the upper mold (5) and the lower mold (6), the clearance between the two mold pieces will now be correct and will be uniform over the entire span (11) of the movable ram (11) such that the pressure on the material will be equal at all parts, whereas in the case of a conventional press, the clearance between the upper and lower mold pieces was larger in the center part and smaller at both end parts.

According to the present invention, since the vertical position of the holder (4) relative to the movable ram (11) can be adjusted by turning the eccentric shaft member (6) which is provided for each adapter (3) located on the lower edge of the movable ram (11), the clearance between both molds facing each other can be uniform and the accuracy of the form can be greatly improved.

Furthermore, because it is easy to check the angle of rotation of the eccentric shaft member (6), the setting of the position of the holder (4) can be performed correctly and promptly, and the object of the invention is thereby achieved excellently with superior effects obtained.

I claim:

1. A press comprising a table for receiving a lower mold, a movable ram movable up-and-down relative to said table, said ram being provided with a holder for supporting said upper mold, said holder utilizing an adapter mounted in alignment on a lower edge of said ram, said adapter being provided with an eccentric shaft member which is operable to adjust the vertical position of said holder relative to said ram by rotating said eccentric shaft member, said adapter comprising a front plate and a rear plate, said front plate being spaced from said rear plate, a middle plate disposed between said front and rear plates, said eccentric shaft member having two end sections and a center section, said center section being eccentrically disposed relative to said two end sections, said two end sections being rotatably received in said front plate and said rear plate, said middle plate having an opening in which said center section is received such that rotation of said eccentric shaft member raises and lowers said middle plate relative to said front and rear plates.

2. A press according to claim 1 further comprising fastening means fastening said front and rear plates to said movable ram.

3. A press according to claim 1 further comprising fastening means fastening said front and rear plates together.

4. A press according to claim 1 further comprising spaced support pieces, first fastening means engaging said support pieces for mounting said upper mold thereon, a connector plate disposed between said front and rear plates and extending to a position between said spaced support pieces, and second fastening means fastening said connector plate to said front and rear plates.

5. A press according to claim 4, wherein front and rear plates have lower surfaces, said support pieces having upper surfaces which abut said lower surfaces of said front and rear plates.

6. A press according to claim 1 further comprising tool receiving means on said eccentric shaft member for receiving a tool to facilitate rotation of said eccentric shaft member.

7. A press comprising a table for receiving a lower mold, a movable ram which moves up-and-down relative to said table, a holder means on said ram for supporting an upper mold, said holder means comprising a front plate and a rear plate, said front plate being spaced from said rear plate, a middle plate disposed between said front and rear plates, an eccentric shaft member having two end sections and a center section, said center section being eccentrically disposed relative to said two end sections, said two end sections being rotatably received in said front plate and said rear plate, said middle plate having an opening in which said center section is received such that rotation of said eccentric shaft member raises and lowers said middle plate relative to said front and rear plates to thereby adjust the vertical position of said upper mold relative to said ram.

* * * * *